United States Patent [19]

Cowsar et al.

[11] Patent Number: 4,784,699

[45] Date of Patent: Nov. 15, 1988

[54] PROCESS FOR DECONTAMINATING MILITARY NERVE AND BLISTER AGENTS

[75] Inventors: Donald R. Cowsar; Richard L. Dunn, both of Birmingham, Ala.; Robert A. Casper, Alpharetta, Ga.

[73] Assignee: The United States of America as represented by the Secretary of the Army, Washington, D.C.

[21] Appl. No.: 36,035

[22] Filed: Apr. 8, 1987

[51] Int. Cl.[4] ..... B08B 5/00

[52] U.S. Cl. ..... 134/42; 134/30; 134/31; 134/11

[58] Field of Search ..... 134/30, 31, 42, 11

[56] References Cited

U.S. PATENT DOCUMENTS 3,810,788 5/1974 Steyernark ..... 134/42

OTHER PUBLICATIONS

Snelson et al, J. Environ. Sci Health Part A, Environ Sci Eng 19(7), 775–790, (1984) (abstract only).

*Primary Examiner*—Asok Pal

*Attorney, Agent, or Firm*—Anthony T. Lane; Edward Goldberg; Edward F. Costigan

[57] ABSTRACT

The invention provides a process for decontaminating military nerve agents and blister agents. The process involves contacting the nerve agent and blister agent, particularly clothing and other items contaminated therewith, with gaseous ozone or chlorine dioxide, whereby the agents are oxidized to non-toxic products and thereby decontaminated rapidly, e.g. within a few minutes. The treatment with ozone or chlorine dioxide does not seriously affect the mechanical properties of the contaminated materials, such as fabrics.

3 Claims, No Drawings

PROCESS FOR DECONTAMINATING MILITARY NERVE AND BLISTER AGENTS

GOVERNMENT INTEREST

The invention described herein was made in the course of or under a contract or subcontract thereunder with the Government and may be manufactured, used and licensed by or for the Government for Governmental purposes without the payment to us of any royalties thereon.

BACKGROUND OF THE INVENTION

The present invention relates to a method for decontaminating toxic chemical agents, commonly referred to as nerve agents and blister agents. These agents are of potential use in the battlefield and hence represent a serious threat to military personnel. To combat this threat various types of protective clothing and accessory equipment have been developed. However, such protective clothing and equipment must be decontaminated after they have been exposed to these chemical agents in the battlefield.

In the past the most effective methods for decontaminating such chemical agents have involved treating the contaminated items with bleach (aqueous calcium hypochlorite) or aqueous sodium hydroxide solution containing diethylenetriamine. These methods are not entirely satisfactory, since they employ solutions which are corrosive, hazardous and often have a serious adverse effect on the mechanical properties and function of the items treated. The use of steam autoclaving as well as general wet laundering and dry cleaning methods for decontaminating such items has been found costly, time consuming and impractical in certain situations and hence generally unsatisfactory. It has been reported from the Democratic German Republic that material exposed to the nerve agents Sarin and Soman can be effectively decontaminated by treatment with vapors of 10% aqueous ammonia solution; and ammonia and its derivatives, such as amines, were recommended as universal decontaminants. It has also been proposed to employ gaseous chlorine for deactivating such chemical agents but the results produced are deficient for various reasons.

An object of the present invention is to provide a process for deactivating nerve and blister agents at a rapid rate in gaseous or non-gaseous phase.

Another object of the invention is to provide a process for rapidly decontaminating clothing and other items exposed to such chemical agents without serious adverse effect on the mechanical properties of such items.

A further object of the invention is to provide a process whereby large quantities of clothing and other items contaminated with such chemical agents can be rapidly and safely decontaminated in a practical manner.

Other objects will become apparent from the following description of this invention.

SUMMARY AND DETAILED DESCRIPTION OF THE INVENTION

In accordance with the present invention these objects can be accomplished by contacting nerve and blister agents with a gaseous oxidant selected from the group consisting of ozone and chlorine dioxide. The agents are thereby rapidly oxidized and converted to non-toxic products within a few minutes.

The nerve and blister agents can be treated either in the gaseous or liquid state and in the presence or absence of a substrate, such as fabrics made of cotton, rayon, wool, nylon and polyester, natural and synthetic polymers, leather, elastomers such as natural and synthetic rubber, sealants, etc.

The gaseous oxidants of the present invention are of relatively low moleular weight and possess great penetrating and permeating power into materials such as clothing and accessories and especially masses of such materials. Large quantities of clothing and other items contaminated with nerve or blister agent can be rapidly decontaminated in the field in a practical and effective manner by contacting the items with ozone or chlorine dioxide in a closed container, such as a metal tank or polyethylene tent.

The gaseous oxidants can be employed alone or in mixture with another gas or vapor, such as air or steam. These gaseous oxidants are effective in low concentrations. For example, by employing a mixture of about 1000 ppm. chlorine dioxide and about 15 ppm. mustard gas simulant in air at room temperature, a total deactivation of the simulant resulted in two minutes. The amount of gaseous oxidant of this invention required to deactivate nerve agents and blister agents varies according to the amount and nature of such chemical agent to be decontaminated.

The oxidants of the present invention, ozone and chlorine dioxide, are effective for deactivating/decontaminating nerve agents and blister agents generally. Examples of nerve agents include Sarin, Soman and VX. A typical formula for a nerve agent (VX) is as follows, viz

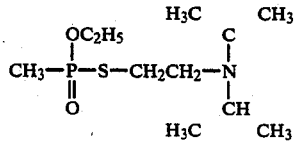

Examples of blister agents include mustard (HD) and Lewisite (L).

The process of the present invention is advantageous because ozone and chlorine dioxide can be readily generated, are rapidly effective at very low concentrations and are readily removable from the decontaminated materials because they are gases. Further, they are non-corrosive and do not seriously degrade the mechanical properties of the decontaminated materials, which is important since it is essential that the structural and mechanical properties of military items, such as clothing, subjected to decontamination processes be retained as much as possible. Ozone is preferred, since it is a more powerful decontaminating gas and can be readily generated in the field by ultra violet radiation or glow discharge.

The invention is illustrated in the following examples, wherein for safety considerations half-mustard, 2-chloroethyl ethyl sulfide, was employed as the simulant for mustard gas bis(2-chloroethyl)sulfide, (agent HD) and ethyl methylphosphorofluoridate was used as the simulant for G agent, methyl isopropylphosphorofluoridate (Sarin). These simulants were selected because they are relatively non-toxic to humans and because they possess similar properties and imitate reasonably closely the response of the live nerve and blister agents. The properties of each agent and its simulant are set forth in Table 1.

Ozone, chlorine, bromine, chlorine dioxide, ammonia and other reactive gases were tested for their efficacy to deactivate the simulants in the gas phase. The more effective reactive gases were also tested for their effectiveness for decontaminating protective clothing and other military field items impregnated with the simulants. In addition, the effect of the reactive gas treatment on the material properties of the various military clothing and other items was evaluated. The military items are described in Table 2.

GAS PHASE DEACTIVATION OF SIMULANTS

The tests were carried out by injecting the reactive gas into a highly agitated dispersion of the simulant in air at room temperature and analyzing the agitated gas system to determine the reduction of simulant concentration with time by means of an infrared gas analyzer.

The test results are set forth in Tables 3 and 4, which show that ozone, chlorine dioxide, chlorine and bromine were the most effective gases employed in the gas phase deactivation of the nerve and blister agent simulants.

TABLE 3-continued

Gas-Phase Reactivity of Candidate Gases with Half-Mustard

| Candidate gas | Gas, ppm | Initial simulant, ppm | Elapsed time, min | Final simulant, ppm | % Reduction |
|---|---|---|---|---|---|
| Bromine | 1000 | 15.41 | 3 | 0 | 100 |
| Chlorine Dioxide | 1095 | 15.25 | 2 | 0 | 100 |
| Hydrogen Sulfide | 1000 | 25.40 | 89 | 18.34 | 28 |
| Ethanethiol | -C-[b] | | | | |
| Dimercaprol | 975 | 15.25 | 14 | 14.39 | 6 |
| Propionaldehyde | 1071 | 21.01 | 16 | 20.82 | 1 |
| Formaldehyde | 1205 | 14.65 | 17 | 14.06 | 4 |
| Ethylene Oxide | 1000 | 19.83 | 73 | 18.72 | 11 |

[a]"N/T" = not tested.
[b]"-C-" = retention time of ethanethiol interfered with reading of half-mustard concn.

TABLE 4

Gas-Phase Reactivity of Candidate Gases with Nerve Simulant

| Candidate gas | Gas, ppm | Initial simulant, ppm | Elapsed time, min | Final simulant, ppm | % Reduction |
|---|---|---|---|---|---|
| Ammonia | 1180 | 0.281 | 25 | 0.281 | 0 |
| Methylamine | N/T[a] | | | | |
| Ethylamine | N/T | | | | |
| Dimethylamine | 1180 | 0.285 | 25 | 0.259 | 9 |
| Ozone | 0.120 | 0.122 | 25 | 0.014 | 88 |
| Chlorine | 10000 | 0.274 | 35 | 0.134 | 51 |
| Bromine | N/T | | | | |
| Chlorine Dioxide | 790 | 0.133 | 30 | 0.085 | 36 |
| Hydrogen Sulfide | $10^6$ | 0.176 | 25 | 0.136 | 22.7 |
| Ethanethiol | 1787 | 0.154 | 30 | 0.126 | 18 |
| Dimercaprol | N/T | | | | |
| Propionaldehyde | 1830 | 0.127 | 30 | 0.127 | 0 |
| Formaldehyde | 1760 | 0.166 | 25 | 0.166 | 0 |
| Ethylene Oxide | 5000 | 0.172 | 25 | 0.172 | 0 |

[a]"N/T" = not tested.

TABLE 1

Comparison of Agent and Simulant

| | Agent | Simulant | Agent | Simulant |
|---|---|---|---|---|
| Name | Sarin | Ethyl methylphosphorofluoridate | mustard (HD) | 2-chloroethyl ethyl sulfide |
| Structure | $F(CH_3)_2CHOPOCH_3$ | $FCH_3OPOC_2H_5$ | $(ClCH_2CH_2)_2S$ | $ClCH_2CH_2SCH_2CH_3$ |
| State at 25° C. | liquid | — | liquid | liquid |
| Boiling point, °C. | 147 | — | 227 | 156 |
| Vapor pressure at 20° C., mmHg | 2.20 | — | 0.07 | 3.20 |

TABLE 2

Material Items Evaluated During Program

| Material identification No. | Military serial No. | Description |
|---|---|---|
| B485-2-1 | 8415-00-407-1063 | outer cloth of chemical-protective suit |
| B485-2-2 | 8415-00-407-1063 | carbon urethane layer of chemical-protective suit |
| B485-2-4 | 8415-01-084-1718 | trouser of camouflage material |
| B485-2-6 | 8415-01-084-1651 | coat of camouflage material |
| B485-2-8 | 8430-01-021-5978 | chemical-protective footwear covers |
| B485-2-10 | 8415-01-033-5978 | chemical-protective glove set |
| B485-2-12 | 8305-00-148-9740 | textile webbing |
| B485-2-14 | — | butyl-coated cloth |
| B485-2-16 | — | Nomex cloth |
| B485-2-18 | — | canvas |

TABLE 3

Gas-Phase Reactivity of Candidate Gases with Half-Mustard

| Candidate gas | Gas, ppm | Initial simulant, ppm | Elapsed time, min | Final simulant, ppm | % Reduction |
|---|---|---|---|---|---|
| Ammonia | 1000 | 21.12 | 38 | 18.73 | 11 |
| Methylamine | N/T[a] | | | | |
| Ethylamine | N/T | | | | |
| Dimethylamine | 1000 | 13.55 | 10 | 14.59 | 0 |
| Ozone | N/T | | | | |
| Chlorine | 1000 | 14.02 | 1 | 0 | 100 |

DECONTAMINATION OF MILITARY MATERIALS

Samples of each military material were cut into one inch squares and each sample was placed in a 50 cc serum vial, which was then sealed. The samples and controls were carried out in triplicate. Each sample and control was inoculated with the liquid simulant by means of a hypodermic syringe, which was employed to penetrate the vial septum and apply the simulant directly onto the surface of the test samples as well as the control samples. The materials were then allowed to equilibrate for one hour, after which the control samples were extracted with either 5 mL of cyclohexane or 5 mL of methanol. The test samples were removed from the vial and placed in a larger exposure chamber containing the decontaminating gas at a specified concentration. After a one hour exposure period the test samples were degassed by venting the exposure chamber and then extracted in the same manner as the control samples. The concentration of simulant in the extract was determined by gas chromatography (GC).

Tables 5 to 8 set forth the test results comparing the effectiveness of the gases to decontaminate the various military items contaminated with the simulants, as measured by the reduction in active extractable simulant. The tables indicate the types of material used, the amounts and types of simulants and decontaminating gas employed and the reduction in simulant concentration after the one hour exposure period.

The results show that ozone was generally highly effective for decontaminating material contaminated with either blister agent or nerve agent simulant, while chlorine dioxide was generally similarly effective for decontaminating material containing blister agent simulant but less effective for decontaminating material containing nerve agent simulant. The results also show that ozone and chlorine dioxide are significantly superior to chlorine and bromine for deactivating the agent simulants. Thus, as is evident from Table 6, approximately $0.6\times10^{-6}$ moles of chlorine dioxide and approximately $8\times10^{-6}$ moles of ozone were effective for deactivating $8.55\times10^{-6}$ moles of agent simulant, whereas approximately $6\times10^{-4}$ moles of chlorine and approximately $1\times10^{-4}$ moles of bromine were required to deactivate the same amount of agent simulant, as shown in Table 5.

EFFECT OF DECONTAMINATING GASES ON MECHANICAL PROPERTIES OF MILITARY CLOTHING AND OTHER ITEMS

To determine the effect of the reactive gas treatment on the decontaminated items, the fabric samples were exposed to the reactive gases under conditions similar to those used to accomplish effective decontamination of samples contaminated with the aforesaid simulants. The samples were then degassed and the mechanical properties of the gas treated items and corresponding untreated items were determined by means of an Instron Model TMS instrument. The results are set forth in Tables 9 and 10 which indicate the type of material treated, the type and concentration level of decontaminating gas employed, and the reduction in tensile strength of the material resulting from the gas treatment. A comparison of the data set forth in these tables shows that the treatment with ozone did not seriously affect the strength of the clothing and other materials treated.

TABLE 5

Effectiveness of Chlorine and Bromine in Decontaminating Materials Spiked with Half-Mustard

| Material identification No. | Amount of simulant, moles × $10^6$ | Amount of decontaminating gas, moles × $10^4$ | | Decontamination effectiveness reduction in simulant, % | | Exposure period, hr |
|---|---|---|---|---|---|---|
| | | $Cl_2$ | $Br_2$ | $Cl_2$ | $Br_2$ | |
| B485-2-1 | 8.55 | 5.97 | 1.16 | 100 | 100 | 1 |
| B485-2-2 | 8.55 | 5.97 | 1.16 | 25 | 91 | 1 |
| B485-2-4 | 8.55 | 5.97 | 1.16 | 100 | 100 | 1 |
| B485-2-6 | 8.55 | 5.97 | 1.16 | 100 | 100 | 1 |
| B485-2-8 | 8.55 | 5.97 | 1.16 | 73 | 75 | 1 |
| B485-2-10 | 8.55 | 5.97 | 1.16 | 56 | 40 | 1 |
| B485-2-12 | 8.55 | 5.97 | 1.16 | 77 | 100 | 1 |
| B485-2-14 | 8.55 | 5.97 | 1.16 | 67 | 85 | 1 |
| B485-2-16 | 8.55 | 5.97 | 1.16 | 92 | 100 | 1 |
| B485-2-18 | 8.55 | 5.97 | 1.16 | 92 | 100 | 1 |

TABLE 6

Effectiveness of Chlorine Dioxide and Ozone in Decontaminating Materials Spiked with Half-Mustard

| Material identification No. | Amount of simulant, moles × $10^6$ | Amount of decontaminating gas, moles × $10^6$ | | Decontamination effectiveness reduction in simulant, % | | Exposure period, hr |
|---|---|---|---|---|---|---|
| | | $ClO_2$ | $O_3$ | $ClO_2$ | $O_3$ | |
| B485-2-1 | 8.55 | 0.614 | 8.21 | 100 | 100 | 1 |
| B485-2-2 | 8.55 | 0.614 | 8.21 | 50 | 6.6 | 1 |
| B485-2-4 | 8.55 | 0.614 | 8.21 | 100 | 100 | 1 |
| B485-2-6 | 8.55 | 0.614 | 8.21 | 100 | 100 | 1 |
| B485-2-8 | 8.55 | 0.614 | 8.21 | 100 | 92 | 1 |
| B485-2-10 | 8.55 | 0.614 | 8.21 | 100 | 84 | 1 |
| B485-2-12 | 8.55 | 0.614 | 8.21 | —[a] | 100 | 1 |
| B485-2-14 | 8.55 | 0.614 | 8.21 | — | 100 | 1 |
| B485-2-16 | 8.55 | 0.614 | 8.21 | — | 100 | 1 |
| B485-2-18 | 8.55 | 0.614 | 8.21 | — | 93 | 1 |

[a]"—" = not evaluated.

TABLE 7

Effectiveness of Chlorine Dioxide and Ozone in Decontaminating Materials Spiked with G-Analog

| Material identification No. | Amount of simulant, moles × $10^5$ | Amount of decontaminating gas, moles × $10^6$ | | Decontamination effectiveness reduction in simulant, % | | Exposure period, hr |
|---|---|---|---|---|---|---|
| | | $ClO_2$ | $O_3$ | $ClO_2$ | $O_3$ | |
| B485-2-1 | 1 | 0.614 | 8.21 | 33 | 92 | 1 |
| B485-2-2 | 1 | 0.614 | 8.21 | 68 | 8.3 | 1 |
| B485-2-4 | 1 | 0.614 | 8.21 | 13 | 91 | 1 |
| B485-2-6 | 1 | 0.614 | 8.21 | 13 | 91 | 1 |
| B485-2-8 | 1 | 0.614 | 8.21 | 37 | 92 | 1 |
| B485-2-10 | 1 | 0.614 | 8.21 | 51 | 58 | 1 |

TABLE 7-continued

| Material identification No. | Amount of simulant, moles × $10^5$ | Effectiveness of Chlorine Dioxide and Ozone in Decontaminating Materials Spiked with G-Analog: Amount of decontaminating gas, moles × $10^6$ | | Decontamination effectiveness reduction in simulant, % | | Exposure period, hr |
|---|---|---|---|---|---|---|
| | | $ClO_2$ | $O_3$ | $ClO_2$ | $O_3$ | |
| B485-2-12 | 1 | 0.614 | 8.21 | 0 | 89 | 1 |
| B485-2-14 | 1 | 0.614 | 8.21 | 18 | 100 | 1 |
| B485-2-16 | 1 | 0.614 | 8.21 | 39 | 100 | 1 |
| B485-2-18 | 1 | 0.614 | 8.21 | 47 | 42 | 1 |

TABLE 8

| Material identification No. | Amount of simulant, moles × $10^5$ | Effectiveness of Chlorine and Bromine in Decontaminating Materials Spiked with G-Analog: Amount of decontaminating gas, moles × $10^4$ | | Decontamination effectiveness reduction in simulant, % | | Exposure period, hr |
|---|---|---|---|---|---|---|
| | | $Cl_2$ | $Br_2$ | $Cl_2$ | $Br_2$ | |
| B485-2-1 | 1 | 4.08 | 1.16 | 27 | 59 | 1 |
| B485-2-2 | 1 | 4.08 | 1.16 | 0 | 0 | 1 |
| B485-2-4 | 1 | 4.08 | 1.16 | 16 | 19 | 1 |
| B485-2-6 | 1 | 4.08 | 1.16 | 16 | 19 | 1 |
| B485-2-8 | 1 | 4.08 | 1.16 | 75 | 89 | 1 |
| B485-2-10 | 1 | 4.08 | 1.16 | 77 | 94 | 1 |
| B485-2-12 | 1 | 4.08 | 1.16 | 0 | 12 | 1 |
| B485-2-14 | 1 | 4.08 | 1.16 | —[a] | — | — |
| B485-2-16 | 1 | 4.08 | 1.16 | 13 | 71 | 1 |
| B485-2-18 | 1 | 4.08 | 1.16 | 44 | 48 | 1 |

[a]"—" = not evaluated.

TABLE 9

| Sample No. | Effect of Candidate Gases on Tensile Strength of Combat Materials: 10,000 ppm $Cl_2$, 1 hr | | 10,000 ppm $Cl_2$, 16 hr | | 100,000 ppm $Cl_2$, 1 hr | | 10,000 ppm $Br_2$, 1 hr | | 8 ppm $O_3$, 40 min | |
|---|---|---|---|---|---|---|---|---|---|---|
| | Mean | SD | Mean | SD | Mean | SD | Mean | SD | Mean | SD |
| B425-2-1 | 7,090 | 202 | N/T[a] | — | 11,490 | 540 | 6,580 | 466 | 3,768 | 109 |
| B485-2-2 | 980 | 16 | N/T | — | 1,130 | 37 | 984 | 146 | 821 | 68 |
| B485-2-4 | 9,390 | 223 | 10,380 | 575 | N/T | — | 12,010 | 1,168 | 11,313 | 503 |
| B485-2-6 | 9,390 | 223 | N/T | — | N/T | — | 12,010 | 1,168 | — | — |
| B485-2-8 | 1,300 | 101 | N/T | — | N/T | — | 1,300 | 43 | 1,006 | 42 |
| B485-2-10 | 1,640 | 84 | N/T | — | 1,520 | 120 | 1,560 | 33 | 1,419 | 240 |
| B485-2-12 | 50,000 | 2,133 | N/T | — | N/T | — | 48,670 | 2,800 | 48,862 | 1,606 |
| B485-2-14 | 8,110 | 831 | N/T | — | N/T | — | 8,170 | 562 | 10,752 | 689 |
| B485-2-16 | 14,910 | 830 | N/T | — | 8,960 | 1,360 | 14,610 | 507 | 7,994 | 147 |
| B485-2-18 | 8,920 | 206 | 8,600 | 873 | 7,700 | 634 | 7,780 | 631 | 6,434 | 303 |

[1]"N/T" = not tested.

TABLE 10

| Notebook No. | Serial No. | Mechanical Properties of Untreated Materials: Description | Density, oz/yd$^2$ | Fiber count: warp | Fiber count: fill | Tensile strength, psi: warp | Tensile strength, psi: fill |
|---|---|---|---|---|---|---|---|
| B485-2-1 | 8415-00-407-1063 | Outer cloth-layer of chemical-protective suit | 5.93 | 50 | 88 | 7230 | 13650 |
| B485-2-2 | 8415-01-084-1063 | Carbon/urethane layer of protective suit | 7.89 | —[a] | —[a] | 1110 | —[a] |
| B485-4 | 8415-01-084-1718 | Camouflaged pants | 7.77 | 56 | 88 | 11730 | 14400 |
| B485-6 | 8415-01-084-1651 | Camouflaged coat | 7.77 | 56 | 88 | 11730 | 14400 |
| B485-8 | 8430-01-021-5978 | Chemical-protective footwear covers | 0.59[b] | —[a] | —[a] | 1170 | —[a] |
| B485-10 | 8415-01-033-5978 | Chemical-protective glove set | 0.65[b] | —[a] | —[a] | 1730 | —[a] |
| B485-12 | 8305-00-148-9740 | Textile webbing | | —[a] | —[a] | —[c] | —[a] |
| B485-14 | — | Butyl-covered cloth | 8.99 | —[d] | —[d] | 8430 | 8760 |
| B485-16 | — | Nomex cloth | 14.87 | 68 | 48 | 13010 | 10810 |
| B485-18 | — | Canvas | 17.40 | 24 | 28 | 9150 | 6780 |

[a]No warp or fill.
[b]A solid material. The units are oz/in$^3$.
[c]The fiber the webbing is made of was tested.
[d]No fiber count could be taken. The length of the fiber roll was called warp.

We claim:

1. In an improved process of decontaminating large quantities of protective clothing without substantially degrading said clothing, said clothing having been exposed to chemical warfare simulants, comprising: contacting said clothing for penetration and permeation with chlorine dioxide, a gaseous decontaminant, and degassing said decontaminant from said clothing.

2. The process of claim 1 wherein said clothing is made of a material or mixture selected from the group consisting of cotton, rayon, wool, nylon, polyester, natural polymers, synthetic polymers, leather, elastomers, natural rubber, synthetic rubber, and sealants.

3. The process of claim 1 wherein said chemical warfare simulants are 2-chloroethyl ethyl sulfide and ethyl methylphosphorofluoridate.

* * * * *